US009469111B2

(12) United States Patent
Yamada et al.

(10) Patent No.: US 9,469,111 B2
(45) **Date of Patent: *Oct. 18, 2016**

(54) LIQUID EJECTION HEAD

(71) Applicant: CANON KABUSHIKI KAISHA, Tokyo (JP)

(72) Inventors: Kazuhiro Yamada, Yokohama (JP); Takatsugu Moriya, Tokyo (JP); Zentaro Tamenaga, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/477,021

(22) Filed: Sep. 4, 2014

(65) Prior Publication Data

US 2015/0085018 A1 Mar. 26, 2015

(30) Foreign Application Priority Data

Sep. 24, 2013 (JP) ..... 2013-196836

(51) Int. Cl.
*B41J 2/155* (2006.01)
*B41J 2/14* (2006.01)
*B41J 2/19* (2006.01)

(52) U.S. Cl.
CPC ..... *B41J 2/155* (2013.01); *B41J 2/1433* (2013.01); *B41J 2/19* (2013.01); *B41J 2202/11* (2013.01); *B41J 2202/20* (2013.01)

(58) Field of Classification Search
CPC ..... B41J 2202/07; B41J 2/19; B41J 2002/14169
USPC ..... 347/49, 56
See application file for complete search history.

(56) References Cited

U.S. PATENT DOCUMENTS 6,328,423 B1 * 12/2001 Wong ..... B41J 2/14024 347/49
6,979,077 B2 12/2005 Sakaida
2001/0012041 A1 8/2001 Boyd et al.
2005/0157091 A1 7/2005 Hu et al.

(Continued)

FOREIGN PATENT DOCUMENTS

CN 1442295 A 9/2003
EP 1 338 420 A1 8/2003

(Continued)

OTHER PUBLICATIONS

Search Report in European Patent Application No. 14003237.6, dated Feb. 27, 2015.
Office Action in Chinese Patent Application No. 201410495658.4, dated Oct. 30, 2015.

*Primary Examiner* — Justin Seo
(74) *Attorney, Agent, or Firm* — Fitzpatrick, Cella, Harper & Scinto

(57) ABSTRACT

A liquid ejection head includes a plurality of ejection members, each having an ejection port for ejecting liquid and a liquid chamber for supplying liquid to the ejection port, a base substrate carrying the plurality of ejection members arranged thereon, the base substrate being provided with a common flow channel for supplying liquid to the plurality of liquid chambers, and a plurality of branch ports each allowing the common flow channel to communicate with the plurality of liquid chambers. Each of the branch ports is provided with a notch portion at an upstream side thereof as viewed in the flow direction of liquid flowing through the common flow channel.

13 Claims, 12 Drawing Sheets

(56) References Cited

U.S. PATENT DOCUMENTS

| | | | | |
|---|---|---|---|---|
| 2009/0096838 | A1* | 4/2009 | Chino | B41J 2/1408 347/56 |
| 2010/0214359 | A1 | 8/2010 | Von Essen et al. | |
| 2011/0279548 | A1 | 11/2011 | Yamamoto et al. | |

FOREIGN PATENT DOCUMENTS

| | | | |
|---|---|---|---|
| JP | 03-297653 | A | 12/1991 |
| JP | 3228569 | B2 | 11/2001 |
| WO | 2009/143025 | A1 | 11/2009 |

* cited by examiner

LIQUID EJECTION HEAD

BACKGROUND OF THE INVENTION

1. Field of the Invention

The present invention relates to a liquid ejection head. More particularly, the present invention relates to a liquid ejection head that can suitably be utilized in the technical field of inkjet recording.

2. Description of the Related Art

The thermal system and the piezo system are well known for methods of ejecting liquid by means of liquid ejection heads. With the thermal system, liquid is heated to boil and bubble and the force of the bubbling liquid is employed to eject liquid. With the piezo system, on the other hand, the force by deformation of a piezoelectric element is employed to eject liquid. A liquid ejection head with these systems is formed by laying a plurality of recording element substrates, each having one or more of liquid ejection ports and liquid ejection means, on respective support members, each having one or more than one liquid chambers formed in the inside thereof, regardless if the liquid ejection head is based on the thermal system or on the piezo system. If air bubbles are left in a liquid chamber, the air bubbles may move to an ejection port of the corresponding recording element substrate in an operation of ejecting liquid to give rise to faulty ejections.

As an exemplar solution for the above identified problem, Japanese Patent No. 3,228,569 proposes an arrangement of providing the inner wall of each liquid chamber with a groove while making the width of the liquid chamber narrower at and near the corresponding recording element substrate than the remaining part of the liquid chamber to produce a constricted part in the liquid chamber. With this arrangement, bubbles, if any, in a liquid chamber can be trapped within the liquid chamber and liquid is reliably fed to the corresponding recording element substrate by way of the groove.

In recent years, line heads have been getting popularity for commercial recording applications of liquid ejection heads. Line heads are liquid ejection heads having a width as long as the width of the recording mediums to be used with the liquid ejection head. In a line head, a large number of ejection ports from which liquid is ejected are arranged highly densely than ever. In general, a line head is formed by arranging a plurality of recording element substrates on respective support members that are by turn arranged on a base substrate. In commercial recording applications, line heads are required with high reliability to provide a high recording speed and an image quality above a certain quality level at the same time. Therefore, occurrences of faulty ejections due to air bubbles as mentioned above are far from being desirable.

However, when the arrangement of Japanese Patent No. 3,228,569 is adopted to line heads for commercial recording applications, each of the liquid chambers in a line head is inevitably made small because a very large number of recording element substrates need to be arranged in the line head so that each liquid chamber can hardly secure a space for trapping air babbles in the inside thereof. Additionally line heads that are designed to operate for high speed recording eject a large volume of liquid in a short period of time so that liquid flows at high speed in the liquid chambers of the line head. Then, the air bubbles that are once trapped in a liquid chamber can be pushed toward a corresponding ejection port to give rise to faulty ejections.

SUMMARY OF THE INVENTION

In view of the above-identified problems, therefore, the object of the present invention is to provide a liquid ejection head that can reduce the probability of occurrence of faulty ejections caused by air bubbles.

According to the present invention, the above identified problems are dissolved by providing a liquid ejection head including: a plurality of ejection members, each having an ejection port for ejecting liquid and a liquid chamber for supplying liquid to the ejection port; a base substrate carrying the plurality of ejection members arranged thereon, the base substrate being provided with a common flow channel for supplying liquid to the plurality of liquid chambers; and a plurality of branch ports each allowing the common flow channel to communicate with the plurality of liquid chambers, wherein each of the branch ports is provided with a notch portion at an upstream side thereof as viewed in the flow direction of liquid flowing through the common flow channel.

According to the present invention, there is also provided a liquid ejection head including: a plurality of ejection members, each having an ejection port for ejecting liquid and a liquid chamber for storing liquid to be supplied to the ejection port; and a support member supporting the plurality of ejection members, the support member having a common flow channel for supplying liquid to the plurality of ejection members, wherein the common flow channel communicates with the plurality of liquid chambers by way of respective openings, while each of the openings is provided with a notch portion at an upstream side thereof as viewed in the flow direction of liquid flowing through the common flow channel and the upstream side of each of the openings has a profile that is asymmetrical relative to a line passing through the center of gravity of the opening and extending along the flow direction.

According to the present invention, there is also provided a liquid ejection head including: a plurality of ejection members, each having an ejection port for ejecting liquid and a liquid chamber for storing liquid to be supplied to the ejection port; and a support member supporting the plurality of ejection members, the support member having a common flow channel for supplying liquid to the plurality of ejection members, wherein the common flow channel communicates with the plurality of liquid chambers by way of respective openings and an upstream side of each of the openings has a profile that is asymmetrical relative to a line passing through the center of gravity of the opening and extending along the flow direction.

Further features of the present invention will become apparent from the following description of exemplary embodiments with reference to the attached drawings.

DESCRIPTION OF THE EMBODIMENTS

Now, preferred exemplar embodiments of the present invention will be described below by referring to the accompanying drawings. Note, however, that the scope of the present invention is defined only by the appended claims. In other words, the following description of the embodiments by no means limits the scope of the present invention. For example, the shapes, the positional arrangements and so on that are described below do not limit the scope of the present invention by any means. Similarly, while the embodiments that are described below employ recording element substrates that are based on a thermal system, liquid ejection means that are applicable to the present invention are not limited to the thermal system and recording embodiment substrates that are based on a piezo system can also be used for the purpose of the present invention.

(Structure of Liquid Ejection Head)

Figure 1:
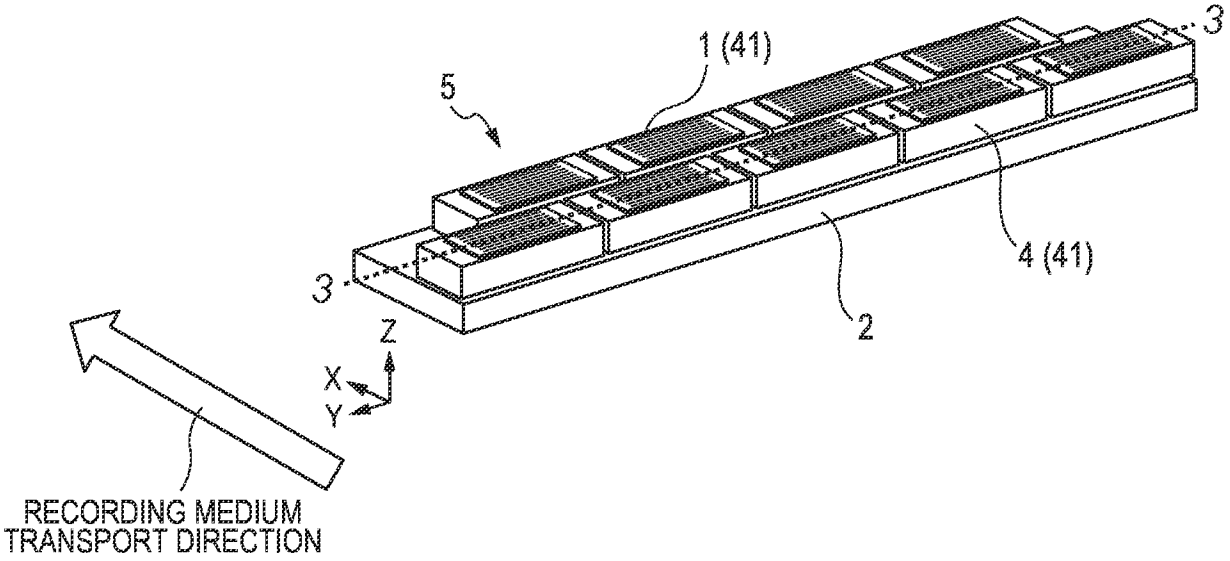
FIG. 1 is a schematic perspective view of an embodiment of liquid ejection head according to the present invention, which is a line head having recording element substrates arranged in a zigzag manner.

FIG. 1 is a schematic perspective view of an embodiment of liquid ejection head according to the present invention, which is a line head in which recording element substrates are arranged in a zigzag manner. The liquid ejection head 5 includes a plurality of ejection members 41 and a base substrate 2. For this embodiment, an ejection member 41 for ejecting liquid such as ink is formed by a recording element substrate 1 and a support member 4. Thus, the recording element substrates 1 are arranged individually on the respective support members 4. The ejection members 41 are arranged on the base substrate 2 in a zigzag manner in the longitudinal direction of the base substrate 2.

Figure 2A:
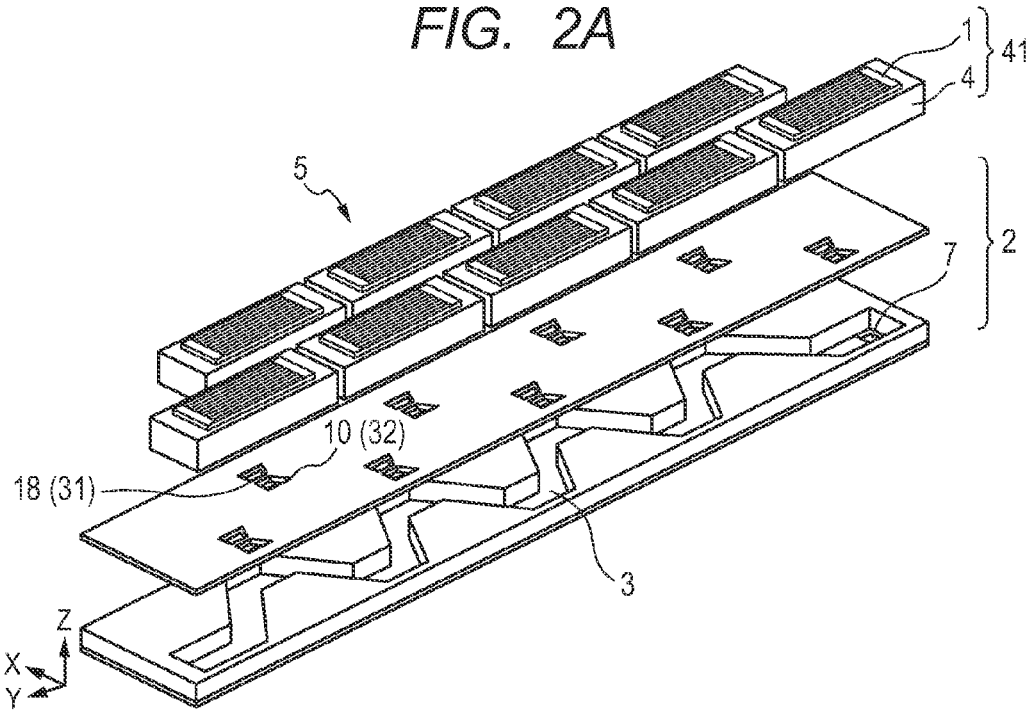
FIGS. 2A, 2B and 2C are exploded schematic perspective views of the liquid ejection head of FIG. 1.
Figure 2B:
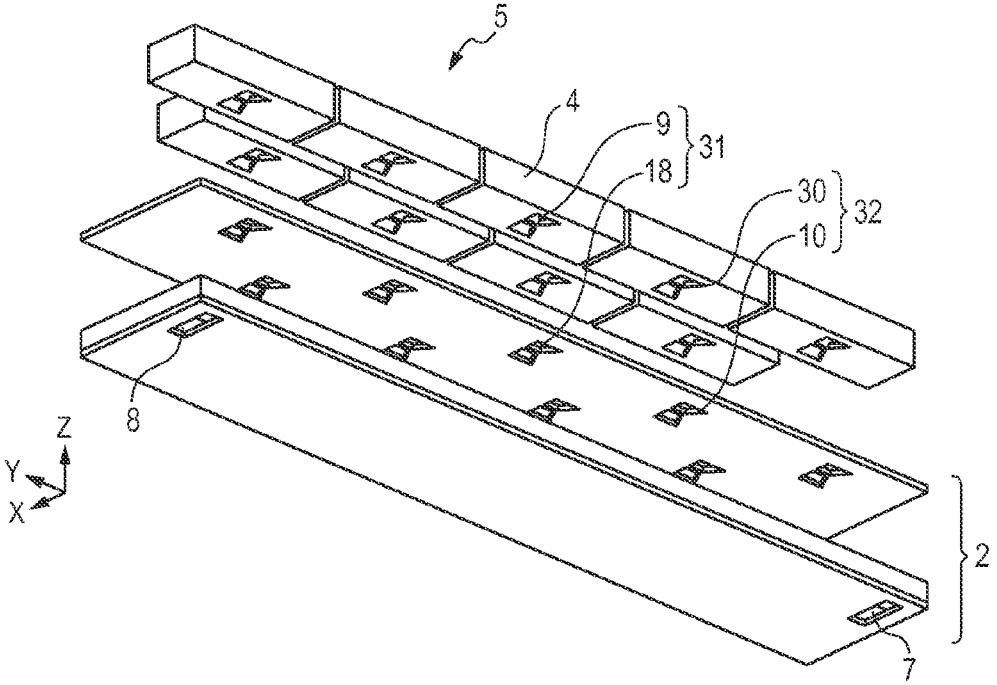
Figure 3A:
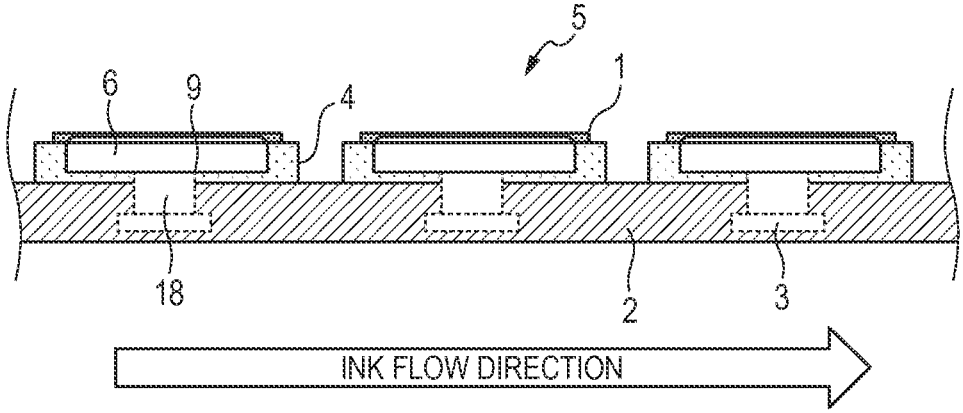
FIGS. 3A and 3B are schematic cross-sectional views of part of the liquid ejection head of FIG. 1 taken along line 3-3 in FIG. 1.

FIG. 2A is an exploded schematic perspective view of the liquid ejection head 5 of FIG. 1 as viewed from the side of the recording element substrates 1 and represents the internal structure of the base substrate 2. FIG. 2B is an exploded schematic perspective view of the liquid ejection head of FIG. 1 as viewed from the side of the base substrate 2. FIG. 3A is a schematic cross sectional view of a part of the liquid ejection head of FIG. 1 taken along line 3-3 in FIG. 1.

A common flow channel 3 through which liquid flows, a flow-in port 7 for allowing liquid to flow into the common flow channel 3 and a flow-out port 8 for allowing liquid to flow out from the common flow channel 3 are formed in the base substrate 2. A liquid chamber 6 (see FIG. 3A) for storing liquid to be supplied to the liquid supply port 14 (see FIG. 5) of a corresponding recording element substrate 1 is formed in each of the support members 4. An introduction port 9, which is an opening, is also formed in each of the support members 4. Liquid is supplied into the liquid chamber 6 of each of support members 4 by way of the introduction port 9 thereof. The common flow channel 3 communicates with the liquid chambers 6 of the support members 4 through respective branch ports 31. Each of the branch ports 31 is provided with a branch port upstream side notch portion 32 that is a substantially tapered notch formed at the upstream side of the branch port 31 as viewed in the flow direction of liquid flowing through the common flow channel 3.

Each of the branch ports 31 includes a distribution port 18, which is an opening formed in the base substrate 2, and an introduction port 9, which is an opening formed in the corresponding support member 4 and communicates with the distribution port 18. Each of the distribution ports 18 is provided with a distribution port upstream side notch portion 10 at the upstream side of the distribution port as viewed in the flow direction of liquid flowing through the common flow channel 3, the distribution port upstream side notch portion 10 operating as part of the corresponding branch port upstream side notch portion 32. Like the distribution ports 18, each of the introduction ports 9 is provided with an introduction port upstream side notch portion 30 at the upstream side of the introduction port as viewed in the flow direction of the liquid flowing through the common flow channel 3, the introduction port upstream side notch portion 30 also operating as port of the corresponding branch port upstream side notch portion 32. Each of the introduction ports 9 and the corresponding distribution port 18 do not necessarily have the same or similar profile. However, in view of the role of the notch portions of guiding liquid, their upstream side notch portions are preferably located close to each other and, more preferably, they lie one on the other.

Figure 3B:
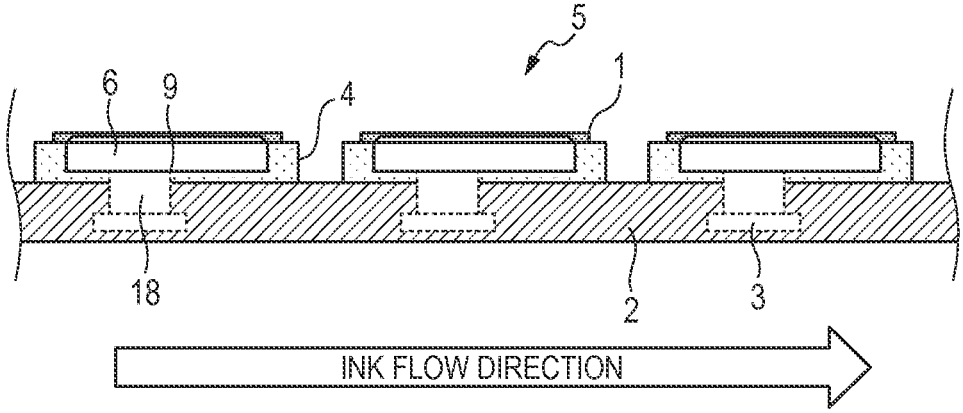

Additionally, each of the liquid chambers 6 and the corresponding introduction port 9 are formed such that the width of the liquid chamber 6 and that of the introduction port 9 substantially agree with each other as viewed in the lateral direction of the corresponding recording element substrate 1. In the instance of FIGS. 2A and 2B, the introduction ports 9 are so arranged as to be located at the center positions of the respective liquid chambers 6 as viewed in the longitudinal direction of the liquid chambers 6 as illustrated in FIG. 3A. However, the introduction ports 9 may alternatively be arranged at respective positions that are offset toward the upstream side of the liquid chambers 6 as illustrated in FIG. 3B if the desired effects can be obtained by arranging those ports at the upstream side. When the liquid ejection head is filled with ink in the initial stages of the use of the liquid ejection head, bubbles are apt to remain at the upstream side in each of the liquid chambers 6 than at the downstream side because liquid is forced to make a detour from the common flow channel 3 before getting into the upstream parts of the liquid chambers 6. However, the quantity of residual bubbles can be reduced at the upstream sides of the liquid chambers 6 when introduction ports 9 are formed at the upstream sides of the respective liquid chambers as illustrated FIG. 3B.

The function and the desired profile of the distribution port upstream side notch portions 10 and those of the introduction port upstream side notch portions 30 will be described hereinafter. The base substrate 2 is preferably made of a material representing a low thermal expansion coefficient such as alumina. Additionally, the base substrate 2 is required to represent a degree of rigidity that does not allow the liquid ejection head 5, which is a line head, to warp and a sufficient level of corrosion resistance against liquids. While the base substrate 2 may be formed by using a single plate-shaped member, the use of a laminate of a plurality of thin alumina layers is preferable because a three-dimensional flow channel can be formed in the inside of the base substrate 2 as illustrated in FIG. 2A when the base substrate 2 is made of such a laminate.

Each of the recording element substrates 1 is provided with heaters 13 (see FIG. 5) that are energy generating elements for generating energy to be utilized to eject liquid. This will be described in greater detail hereinafter. The support members 4 are preferably formed by using highly thermally insulating members such as resin-made members so that the heat generated by the heaters 13 in the recording element substrates 1 may hardly be conducted to the base substrate 2 including the common flow channel 3 in the base substrate 2. This arrangement provides an effect of minimizing the temperature difference of the liquid flowing in the common flow channel 3 between the upstream end and the downstream end. In other words, the temperature difference in the liquid flowing toward the ejection ports 11 (see FIG. 5) of the liquid ejection head 5 can be minimized and hence the quantity difference among the liquid droplets that are ejected per unit time from the liquid ejection head 5 can be reduced so that high quality images that are practically free from image irregularities can be recorded. Additionally, due to the thermal insulation effect of the support members 4, if the recording element substrates 1 generate heat to a large extent at the time of high speed recording, the quantity of heat that is conducted to the liquid circulating through the common flow channel 3 can be suppressed to a minimal level. Therefore, the circulating liquid represents minimal temperature changes and hence the liquid temperature control tank 22 (see FIG. 9) that is mounted in the recording apparatus main body along with the liquid ejection head 5 can be operated at a minimal power consumption rate.

When the support members 4, the base substrate 2 and the recording element substrates 1 represent large differences in terms of linear expansion coefficient, a problem of separation of bonded members and resultant ink leakage can take place when the liquid ejection head 5 is driven to operate and the temperatures of the components thereof rise to an undesirable level. Therefore, preferably, the support members 4 are made of a material that represents a small thermal conductivity and the difference of linear expansibility between the recording element substrates 1 and the base substrate 2 is small. Examples of preferable materials to be used for the support members 4 include resin materials, particularly low linear expansibility composite materials prepared by using PPS (polyphenylene sulfide) or PSF (polysulfone) as base material and adding an inorganic filler material such as silica fine particles to the base material.

Figure 2C:
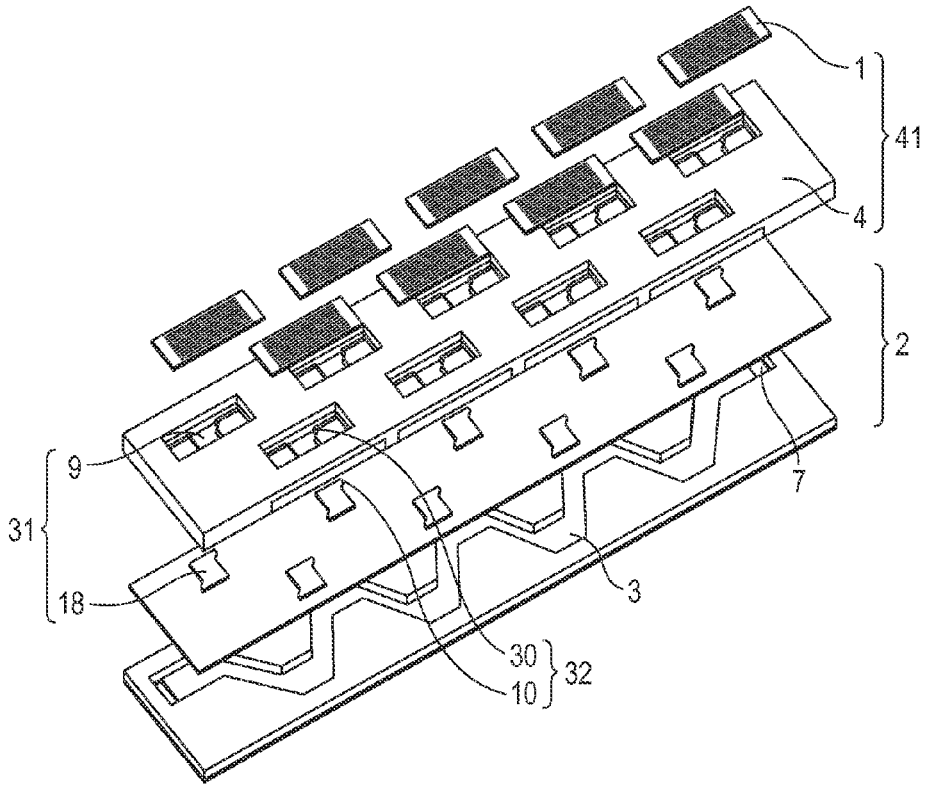

When the thermal conductivity in the directions running along the main surface of each support member 4 can be made low, support members 4, each of which supports a plurality of recording element substrates 1 as illustrated in FIG. 2C, may alternatively be employed. This arrangement provides an advantage of reducing the number of components of the liquid ejection head 5.

Figure 4:
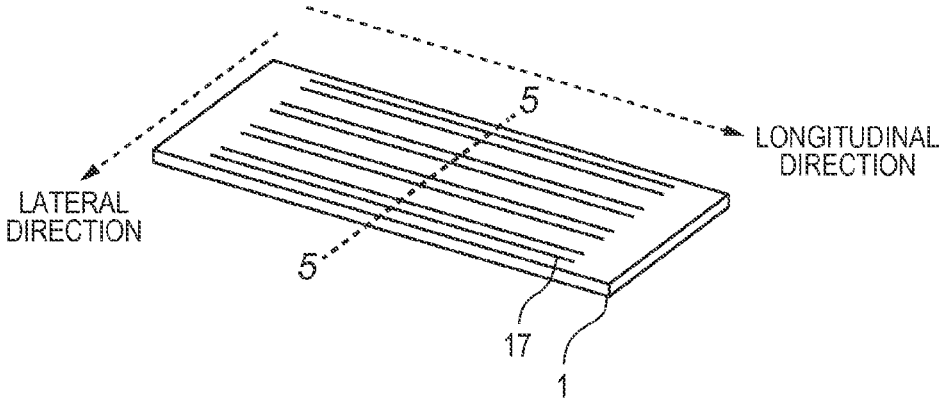
FIG. 4 is a schematic perspective view of a recording element substrate that can be used for the purpose of the present invention.
Figure 5:
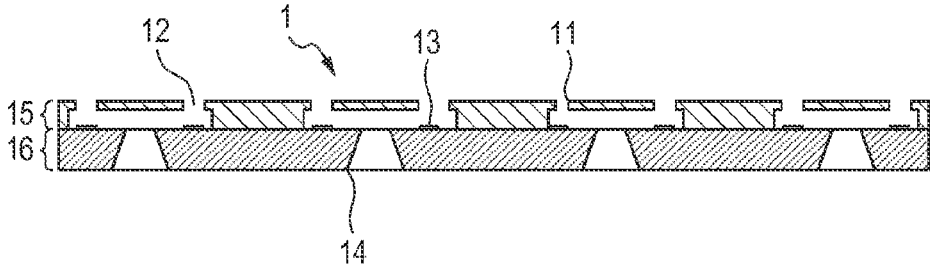
FIG. 5 is a schematic cross-sectional view of the recording element substrate of FIG. 5 taken along line 5-5 in FIG. 4.

Now, the structure of the recording element substrates 1 will be described below. FIG. 4 is a schematic perspective view of a recording element substrate 1 and FIG. 5 is a schematic cross sectional view of the recording element substrate taken along line 5-5 in FIG. 4. Note here that, in the following description, the expressions of "lateral direction" and "longitudinal direction" may appear and they refer to the respective directions indicated in FIG. 4. In this embodiment, a total of eight ejection port rows 17, each having a plurality of ejection ports 11 that eject liquid such as ink, are formed in each recording element substrate 1.

The recording element substrate 1 is based on a thermal system for ink ejection and designed to eject ink by means of heaters 13. The recording element substrate 1 is formed by an ejection port forming layer 15 and a heater board 16. A plurality of ejection ports 11 and so many foaming chambers 12, which are provided to correspond to the respective ejection ports 11, are arranged in the ejection port forming layer 15. Longitudinally extending liquid supply ports 14 for supplying liquid to the foaming chambers 12 and heaters 13 are formed in and on the heater board 16 respectively. In this embodiment, a liquid supply port 14 is provided for two ejection port rows 17. In other words, a total of four liquid supply ports 14 are arranged in this embodiment. As described above, each of the liquid supply ports 14 communicates with the liquid chambers 6 in the corresponding support members 4.

Electric wiring (not illustrated) is provided in the inside of the heater board 16. The electric wiring is electrically connected to the lead electrode of an FPC (flexible print circuit) (not illustrated) arranged on the base substrate 2 or the electrode (not illustrated) arranged in the base substrate 2. As a pulse voltage is input to the heater board 16 from the external control circuit (not illustrated) arranged in the recording apparatus main body by way of the electrode, the heaters 13 are heated to boil the liquid in the foaming chambers 12. Then, liquid droplets are ejected from the selected ejection ports 11.

The plurality of recording element substrates 1 of the liquid ejection head 5 of this embodiment are arranged in rows that run in parallel with each other in the lateral direction of the liquid ejection head 5 and the positions of the recording element substrates 1 in a row are shifted from those of the recording element substrates in the rows located next to the former one in the lateral direction of the liquid ejection head such that the recording element substrates 1 are arranged in a zigzag manner as viewed in the longitudinal direction of the liquid ejection head 5. However, the recording element substrates 1 do not necessarily need to be arranged in a zigzag manner. For example, recording element substrates may alternatively be arranged linearly in rows that run in the longitudinal direction or obliquely relative to the longitudinal direction of the liquid ejection head 5 with a certain angle.

Now the notch portions (including the distribution port notch portions 10 and the introduction port notch portions 30) that are formed in the branching ports 31 (including the distribution ports 18 and the introduction ports 9) and characterize the present invention in an aspect will be described below. Since the branch ports 18 and the introduction ports 9 have a substantially the same profile in this embodiment, only the introduction notch portions 30 will mainly be described below and the description of the distribution port notch portions 10 will be omitted.

Figure 6A:
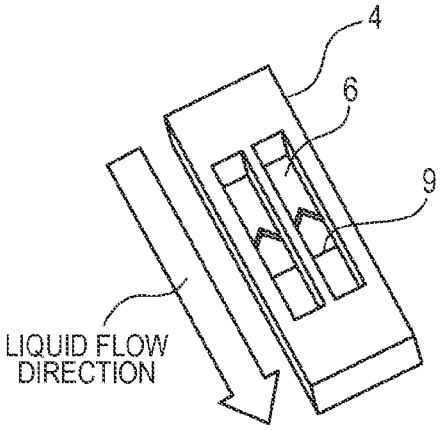
FIGS. 6A, 6B, 6C and 6D are schematic perspective views of introduction ports of the first design alternative.
Figure 6B:
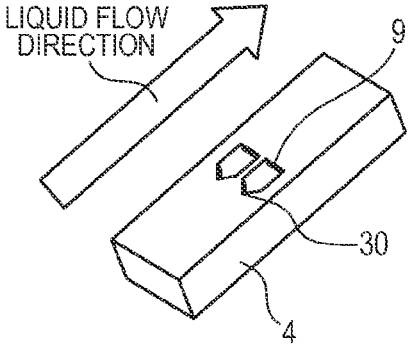
Figure 6C:
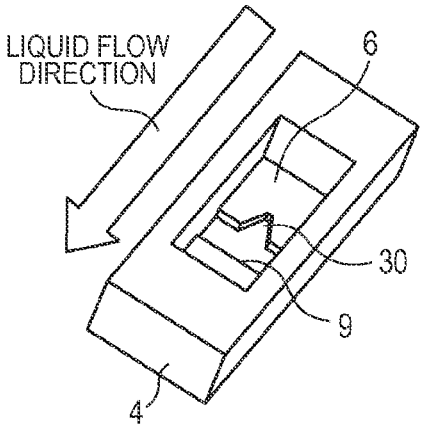
Figure 6D:
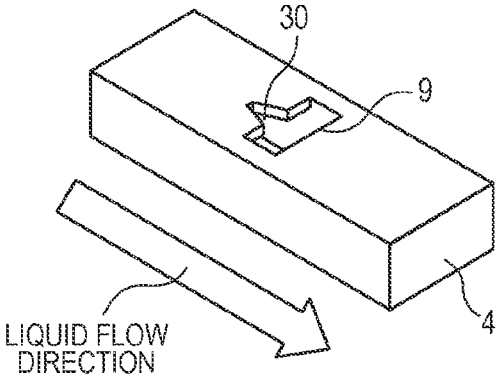

FIGS. 6A and 6C illustrate the first design alternative of introduction port 9. FIGS. 6A and 6C are schematic perspective views of support members 4 as viewed from the side of the corresponding recording element substrates 1. FIGS. 6B and 6D are schematic perspective views of the support members 4 as viewed from the side of the base substrate 2. Note that FIGS. 6A and 6B illustrate an instance where a single support member 4 is provided with two liquid chambers 6. In other words, with the arrangement illustrated in FIGS. 4 and 5, liquid is supplied from each liquid chamber 6 to two of the four liquid supply ports 14 of a single recording element substrate 1. On the other hand, FIGS. 6C and 6D illustrate an instance where a single support member 4 is provided with a single liquid chamber 6. In other words, with the arrangement illustrated in FIGS. 4 and 5, liquid is supplied from a single liquid chamber 6 to all the four liquid supply ports 14 of a single recording element substrate 1.

With this design alternative, the upstream side notch portion 30 of an introduction port 9 is formed at the upstream side of the introduction port 9 so as to be symmetrical relative to the center line of the introduction port 9 running along the flow direction of liquid flowing through the common flow channel 3.

Figure 8:
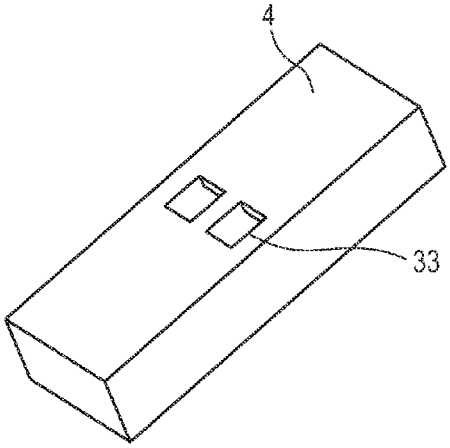
FIG. 8 is a schematic perspective view of an introduction port not provided with any introduction port notch portion.

When an introduction port 33 is not provided at the upstream side of the introduction port with any notch portion as illustrated in FIG. 8 for the purpose of comparison, a situation where the entire introduction port 33 is covered with liquid can frequently take place at the time when the corresponding liquid chamber 6 is filled with liquid. In such a situation, the air existing in the liquid chamber 6 cannot escape into the common flow channel 3 and hence the operation of filling the liquid chamber 6 with liquid does not progress.

On the other hand, when a notch portion 30 is formed in each introduction port 9 at the upstream side of the introduction port 9 as illustrated in FIGS. 6A through 6D, the liquid that is driven to get into the corresponding liquid chamber 6 from the upstream of the common flow channel 3 firstly touches the introduction port upstream side notch portion 30. Then, because liquid can easily be sucked into the liquid chamber 6 from the introduction port upstream side notch portion 30 by capillary force, a situation where the entire introduction port 9 is covered with liquid can be prevented from taking place. Thus, the liquid chamber 6 can be filled with liquid, while allowing the air in the liquid chamber 6 to escape into the common flow channel 3. In other words, the liquid chamber 6 can be filled with ink so as to minimize the residual air bubbles.

Figure 7A:
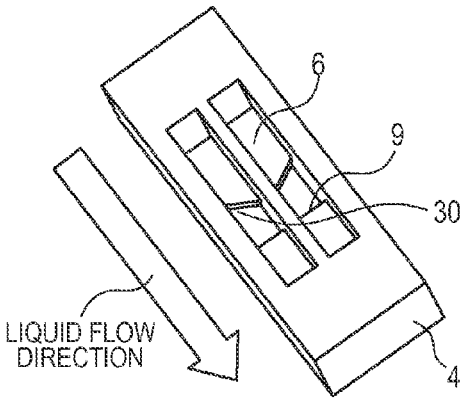
FIGS. 7A and 7B are schematic perspective views of introduction ports of the second design alternative.
Figure 7B:
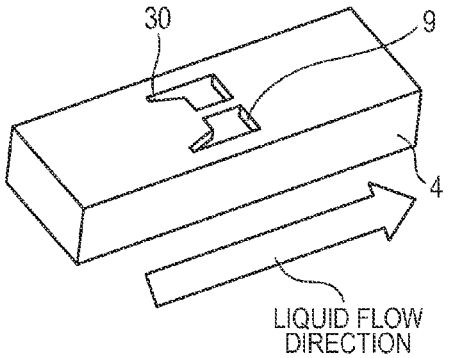

FIG. 7A illustrates the second design alternative of introduction port 9. FIG. 7A is a schematic perspective view of a support member 4 as viewed from the side of the corresponding recording element substrates 1. FIG. 7B is a schematic perspective view of the support member 4 shown in FIG. 7A as viewed from the side of the base substrate 2.

With the second design alternative, the notch portion 30 of each of the introduction ports 9 illustrated in FIG. 7A is formed from one of the opposite ends of the corresponding recording element substrate 1 as viewed in the lateral direction of the substrate 1 to proceed in the longitudinal direction of the substrate 1. In other words, the introduction port upstream side notch portion 30 is formed at the side of one of the opposite ends of the introduction port 9 as viewed in the direction orthogonal to the flow direction of liquid flowing through the common flow channel. Thus, the introduction port 9 is asymmetrical relative to the center line of the introduction port 9 running along the flow direction of liquid flowing through the common flow channel 3. More specifically, the upstream side profile of the opening that operates as the introduction port 9 is asymmetrical relative to a straight line passing through the center of gravity of the opening and running along the liquid flow direction.

The liquid chamber 6 and the introduction port 9 are formed such that the width of the liquid chamber 6 and that of the introduction port 9 substantially agree with each other in the lateral direction of the corresponding recording element substrate 1. Therefore, the liquid that is guided to the introduction port upstream side notch portion 30 from the common flow channel 3 is made to flow into the liquid chamber 6 mainly along the lateral wall located at one of the opposite sides as viewed in the lateral direction of the recording element substrate 1 to fill the liquid chamber 6. Thus, if the recording substrate element 1 has a relatively small width in the lateral direction thereof, liquid can hardly be blocked at the introduction port 9 and air bubbles can hardly remain in the liquid chamber 6.

While the distribution port upstream side notch portion 10 of each distribution port 18 and the introduction port upstream side notch portion 30 of the corresponding introduction port 9 preferably have respective profiles that are similar to each other, they may well have respective profiles that are different from each other. While the distribution ports 18 may not necessarily be provided with respective distribution port upstream side notch portions 10, liquid can more reliably be guided to the above-described lateral wall of the liquid chamber 6 so that air bubbles may hardly be left in the corresponding liquid chamber 6 when the distribution ports are provided with respective upstream side notch portions 10.

For the purpose of the present invention, a "notch portion" may, for example, be produced by partly notching the introduction port 9 at the upstream side in the flow direction of liquid flowing through the common flow channel 3. Alternatively, a "notch portion" may be produced by making the introduction port 9 wholly inclined at the upstream side relative to the flow direction of liquid flowing through the common flow channel 3.

(Liquid Filling Operation)

Figure 9:
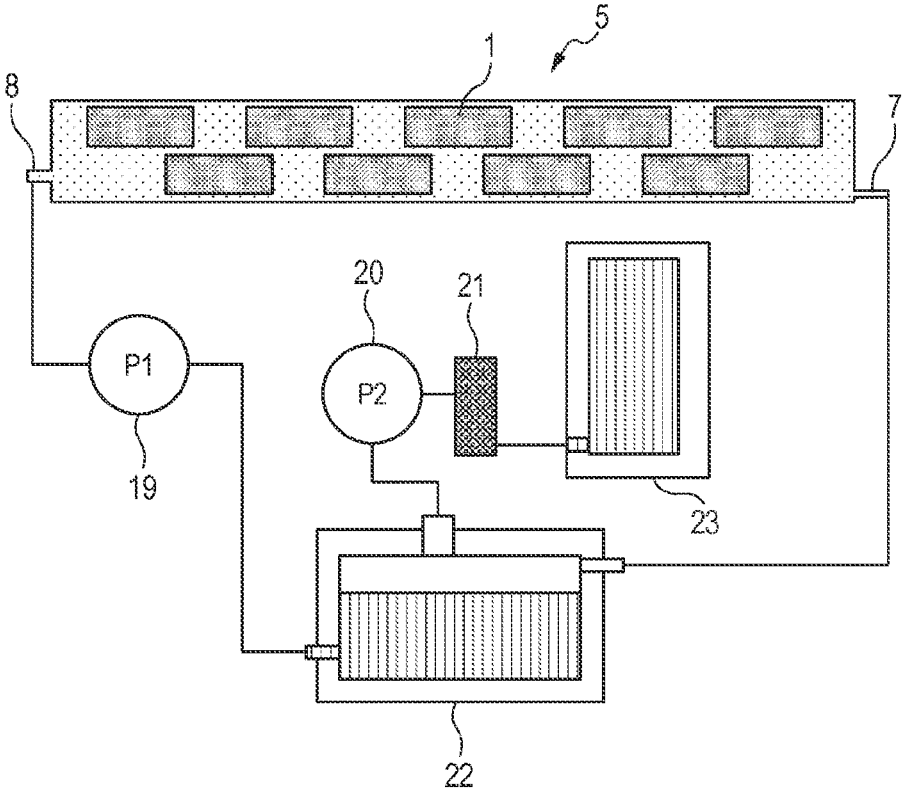
FIG. 9 is a schematic illustration of an exemplar liquid circulation system that can be used for the purpose of the present invention.

Now, the operation of filling a liquid ejection head 5 according to the present invention with liquid will be described below. As illustrated in FIG. 9, a temperature control tank 22, a circulation pump 19, a feed pump 20, a filter 21, a liquid tank 23 and so on are provided in a recording apparatus that includes a liquid ejection head 5 according to the present invention.

In the liquid ejection head 5, the flow-in port 7 for supplying liquid to the common flow channel 3 is linked to a resin tube that communicates with the temperature control tank 22, while the flow-out port 8 for flowing liquid out of the common flow channel 3 is linked to another tube that communicates with the circulation pump 19. As the liquid ejection head 5 is driven, the circulation pump 19 is put into operation to circulate the liquid in the common flow channel 3. The temperature control tank 22 is linked to a heat exchanger (not illustrated) so that it can be subjected to heat exchange operations. The temperature control tank 22 has a function of supplying liquid to the liquid ejection head 5 and at the same time maintaining the temperature of the liquid that circulates through the circulation pump 19 to a constant temperature level. Additionally, the temperature control tank 22 is provided with a hole (not illustrated) for communicating with the open air. In other words, the temperature control tank 22 additionally has a function of expelling bubbles in the liquid in the tank to the outside. The temperature of the liquid flowing out from the flow-out port 8 is controlled and regulated by the temperature control tank 22 before the liquid is directed toward the flow-in port 7 and hence the temperature of the liquid located at the position of the flow-in port 7 can always be held within a certain temperature range. When the temperature of the recording element substrates 1 is too high, the target temperature for the temperature control operation of the temperature control tank 22 may be lowered so as to supply liquid to the liquid ejection head 5 at a relatively low temperature.

The feed pump 20 can transfer liquid from the liquid tank 23 that stores liquid to the temperature control tank 22 after removing the foreign objects contained in the liquid by means of the filter 21 so as to supply liquid to the temperature control tank 22 in order to make up for the liquid consumed by the liquid ejection head 5 as a result of an image recording operation.

The circulation pump 19 operates to pump out liquid from the flow-out port 8 in a recording operation. However, when the liquid ejection head 5 is filled with liquid, air needs to be prevented from drawn from each of the ejection ports 11. For this purpose, the circulation pump 19 is driven to produce a liquid flow in the opposite direction (a flow from the downstream to the upstream) to forcibly supply liquid from the flow-out port 8 to the liquid ejection head 5 under pressure.

FIGS. 10A through 10G are a schematic illustration of the results of a VOF (free surface analysis) simulation obtained by analyzing the conditions of a gas-liquid interface in a liquid ejection head 5 realized by using a support member 4 having introduction ports 9 of the second design alternative as shown in FIG. 7A when the liquid ejection head 5 is filled with liquid. Note that FIGS. 10A through 10G illustrate the progress with time of the operation of filling the liquid ejection head 5 with liquid. Also note that a system realized by taking out only one of the two liquid chambers 6 from a support member illustrated in FIG. 7A was treated as target space for analysis for the purpose of reducing the computation load of the simulation. Also note that only a common flow channel 3, a liquid chamber 6, a branch port 31 including a distribution port 18 and an introduction port 9 and a liquid supply port 14 are extracted and arranged in FIGS. 10A through 10G. In the components illustrated in FIGS. 10A through 10G, the dark areas indicate that liquid is there while air exists in other areas. The contact angle of liquid and each of the wall surfaces was made equal to be 53.5°.

Figure 10A:
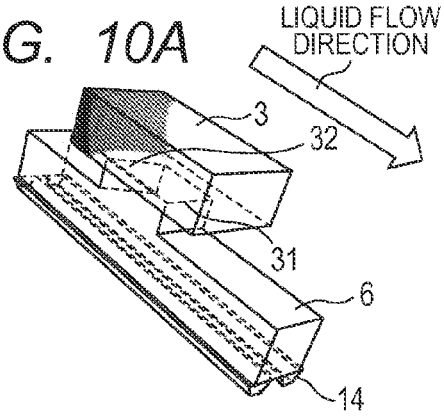
FIGS. 10A, 10B, 10C, 10D, 10E, 10F and 10G are a schematic illustration of the results of a free surface analysis simulation obtained by analyzing the conditions of a gas-liquid interface in a liquid ejection head realized by using a support member having introduction ports of the second design alternative.
Figure 10B:
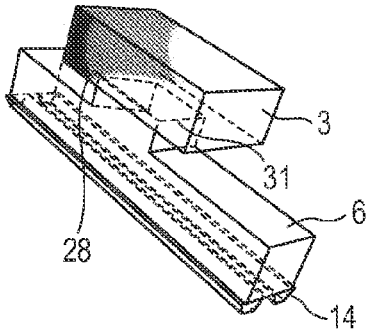

As the liquid filling operation of filling the liquid chamber with liquid from the common flow channel 3 is started as illustrated in FIG. 10A so as to allow liquid to get to the branch port 31, liquid firstly gets to the branch port upstream side notch portion 32 to produce a liquid introduction starting point 28 there as illustrated in FIG. 10B.

Figure 10C:
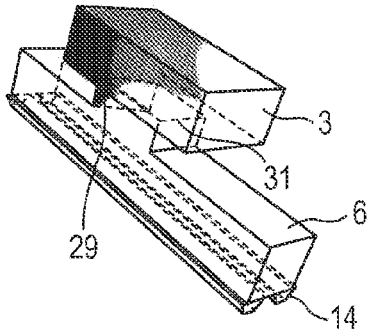

As the liquid filling operation is continued, a liquid drop portion 29 is formed from liquid by the capillary force generated at the branch port upstream side notch portion 32 and penetrates into the liquid chamber 6 by way of the branch port upstream side notch portion 32 as illustrated in FIG. 10C. Thus, the branch port 31 is not blocked by the liquid that is being filled into the liquid chamber 6 and hence a route through which the air in the liquid chamber 6 is discharged to the common flow channel 3 is secured so that liquid can successfully be introduced into the liquid chamber 6.

Figure 10D:
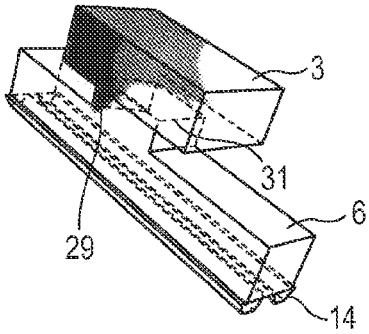
Figure 10E:
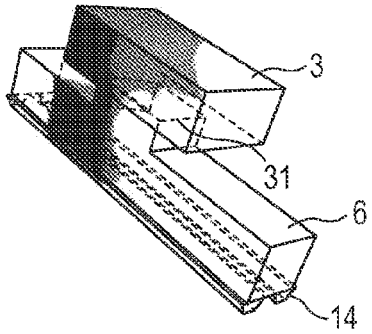

Then, the liquid drop portion 29 is guided to one of the lateral walls of the liquid chamber 6 as viewed in the lateral direction of the recording element substrate 1 as illustrated in FIG. 10D. Thereafter, the liquid drop portion 29 slips down by its own weight to the bottom surface (the surface communicating with the liquid supply port 14) of the liquid chamber 6 by way of the lateral wall as illustrated in FIG. 10E. Thus, a liquid flow route is established from the common flow channel 3 to the bottom surface of the liquid chamber 6 by way of the branch port upstream side notch portion 32 and only one of the lateral walls of the liquid chamber 6 that are disposed oppositely in the lateral direction of the recording element substrate 1. At this time point, a route through which the air found in the liquid chamber 6 can escape is secured at the side of the lateral wall of the common flow channel 3 that is not wet by liquid, or in other words, at the side of one of the lateral walls of the common flow channel 3 that are disposed oppositely in the lateral direction of the recording element substrate 1.

Figure 10F:
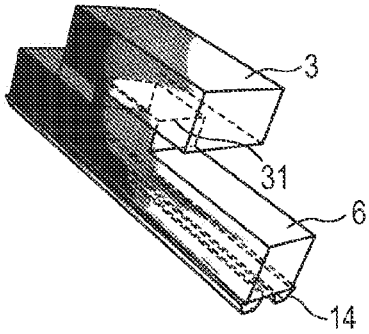
Figure 10G:
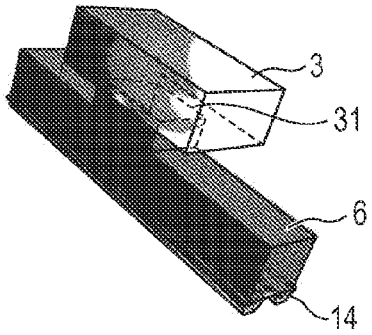

As the liquid filling operation is continued, the above-described liquid flow route remains there without being damaged so that the upstream side space in the liquid chamber 6 as viewed in the flow direction of liquid flowing through the common flow channel 3 is filled with liquid first as illustrated in FIG. 10F. Then, ultimately, the entire liquid chamber 6 is filled with liquid without any air bubbles remaining there as illustrated in FIG. 10G.

FIGS. 11A through 11G are a schematic illustration of the results of a VOF simulation obtained by analyzing the conditions of a gas-liquid interface in a liquid ejection head realized by using a support member having introduction ports 33 with no introduction port notch portion illustrated in FIG. 8 for the purpose of comparison. Note that FIGS. 11A through 11G illustrate the progress with time of the operation of filling the liquid ejection head with liquid. The conditions adopted for the simulation are the same as those of the instance described above by referring to FIGS. 10A through 10G. Also note that a plane that passes the center of the liquid chamber 6 is assumed as a plane of mirror symmetry for the purpose of further reducing the computation load of the analysis illustrated in FIGS. 11A through 11G. While the dimensions of the liquid chamber 6 in FIGS. 11A through 11G may appear to be different from those of the liquid chamber in FIGS. 10A through 10G for this reason, the dimensions of the liquid chamber 6 that were employed for the simulation of FIGS. 11A through 11G are exactly the same as those of the liquid chamber 6 of FIGS. 10A through 10G. For the purpose of easy understanding of the description of the move of liquid, FIGS. 11A through 11G are not necessarily made to respectively correspond to the FIGS. 10A through 10G in terms of the elapse of time from the start of the liquid filling operation.

Figure 11A:
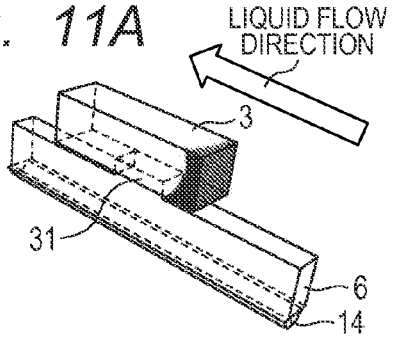
FIGS. 11A, 11B, 11C, 11D, 11E, 11F and 11G are a schematic illustration of the results of a free surface analysis simulation obtained by analyzing the conditions of a gas-liquid interface in a liquid ejection head realized by using a support member not having any introduction port notch portions.
Figure 11B:
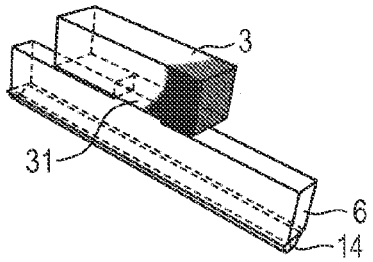
Figure 11C:
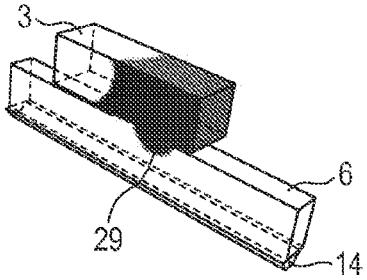

As the liquid filling operation of filling the liquid chamber with liquid from the common flow channel 3 is started as illustrated in FIG. 11A, liquid firstly gets to the branch port 31 as illustrated in FIG. 11B. As the liquid filling operation is continued, a liquid drop portion 29 is formed in the branch port 31 as illustrated in FIG. 11C. Note, however, that FIG. 11C differs from FIG. 10C in that the liquid drop portion 29 is formed as liquid flows from the branch port 31 along the two lateral walls that are oppositely disposed in the lateral direction of the liquid chamber 6. Note that, while it may appear that the liquid drop portion 29 touches only one of the lateral walls of the liquid chamber 6 in FIG. 11C, the liquid drop portion 29 also touches the other lateral wall as a matter of fact for the reason pointed out above although not illustrated, more specifically because FIGS. 11A through 11G illustrate the results obtained by a simulation using a plane of mirror symmetry.

Figure 11D:
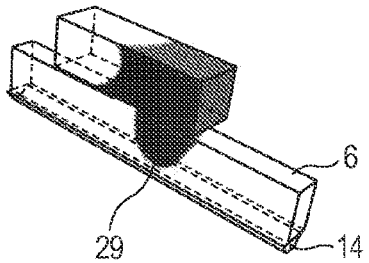
Figure 11E:
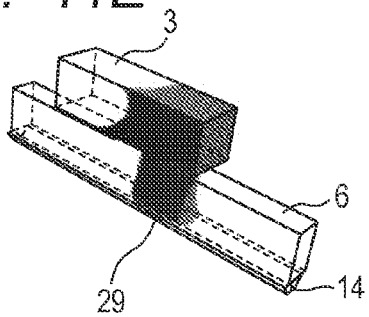
Figure 11F:
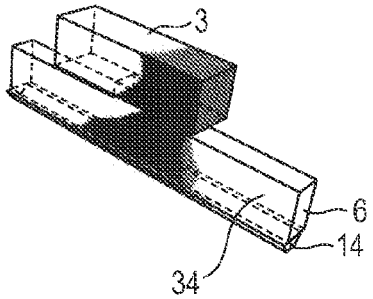

Thereafter, as the liquid filling operation goes on, the liquid drop portion 29 grows bigger as the liquid drop portion moves along the two lateral walls that are disposed oppositely in the lateral direction of the liquid chamber 6 as illustrated in FIG. 11D. Subsequently, the liquid drop portion 29 slips down by its own weight to the bottom surface of the liquid chamber 6 by way of the two lateral walls of the liquid chamber 6 as illustrated in FIG. 11E. Therefore, after the slipping down, unlike FIG. 10E, the air in the liquid chamber 6 located at the upstream side thereof as viewed in the flow direction of liquid flowing through the common flow channel 3 is trapped there before it completely moves to the common flow channel 3. Once such a situation takes place, the remaining air bubble portion 34 persistently exists in the liquid chamber 6 as illustrated in FIGS. 11F and 11G if the liquid filling operation is continued.

Figure 11G:
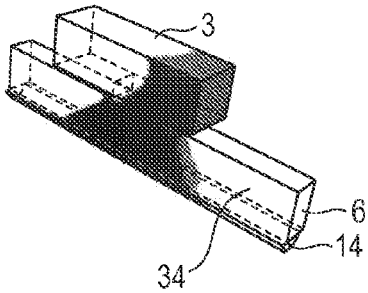

When 10G and 11G is compared with each other, with the use of a conventional branch port that is not provided with a branch port upstream side notch portion in the arrangement illustrated in FIG. 11G, a remaining air bubble portion 34 arises as the operation of filling the liquid chamber 6 with liquid goes on. According to the present invention, to the contrary, it will be seen that the liquid chamber 6 can be filled with liquid without any remaining air bubble portion or at least a minimal remaining air bubble portion as a result of providing the branch port 31 with a branch port notch portion 32 as illustrated in FIGS. 10A through 10G.

Figure 12A:
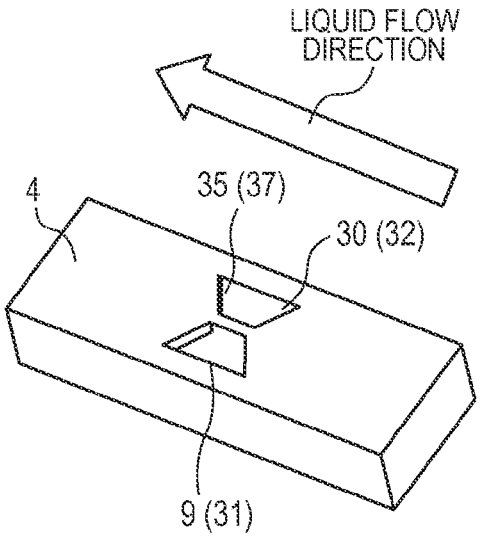
FIGS. 12A and 12B are schematic perspective views of introduction ports of the third design alternative.
Figure 12B:
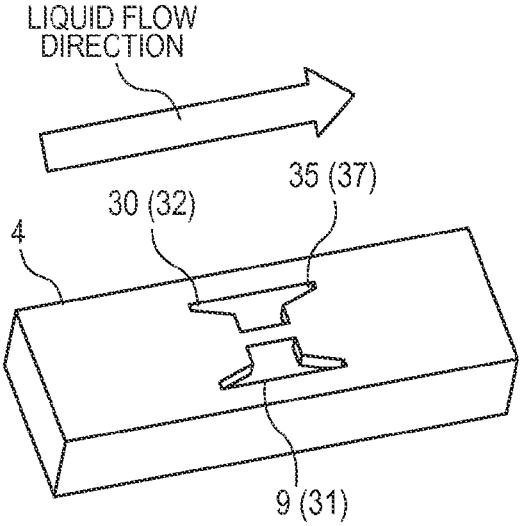

While a branch port upstream side notch portion 32 (an introduction port upstream side notch portion 30) is formed only at the upstream part of the branch port 31 (introduction port 9) as viewed in the flow direction of liquid flowing through the common flow channel 3 with the above-described design alternative, a similar notch portion can additionally be formed at the downstream side of the branch port. This will be described below by way of the third design alternative of introduction port 9 that the branch port 31 includes by referring to FIGS. 12A and 12B.

With this design alternative, the introduction port 9 is provided with an introduction port downstream side notch portion 35 (branch port downstream side notch portion 37) that is different from the introduction port upstream side notch portion 30 in addition to the introduction port upstream side notch portion 30 (branch port upstream side notch portion 32). As the introduction port 9 is provided with an introduction port downstream side notch portion 35, a route through which air in the liquid chamber 6 can escape is secured also at the downstream side of the liquid chamber 6 as viewed in the flow direction of liquid flowing through the common flow channel 3. Then, as a result, air can more effectively be removed from the inside of the liquid chamber 6 at the time of a liquid filling operation.

Now, another embodiment of liquid ejection head 5 according to the present invention will be described below by referring to FIGS. 13A and 13B. In this embodiment, each support member 4 is provided with a spacer 24 and pin holes 25 at the surface facing a corresponding recording element substrate 1. As illustrated in FIG. 13A, in this embodiment, an FPC is arranged on and supported by the spacer 24 and electrically connected to the recording element substrate 1. The pin holes 25 are holes through which respective positioning pins (not illustrated) are made to pass when the support member 4 is mounted on a base substrate 2 in order to secure the positional accuracy of the support member 4 on the base substrate 2. The spacer improves the reliability of the electrical connection between the FPC and the recording element substrate 1 while the pin holes have a function of allowing the support member 4 to be easily and accurately mounted on the base substrate 2.

Meanwhile, with a line head where recording element substrates 1 are arranged in a zigzag manner, the regions of an image recorded by the line head that correspond to the gaps separating the recording element substrates 1 are required to represent an image quality comparable to the image quality of the regions that correspond to the recording element substrates 1. For this purpose, reducing the gap D separating each upstream side row of recording element substrates 1 and the immediately following downstream side row of recording element substrates 1 in the direction of transporting recording mediums will be effective. In other words, if the gap D is large, the influence of a shift of liquid hitting position due to a slippage on the part of the recording medium on which an image is being recorded increases. To meet this requirement of reducing the gap D, a spacer 24 and pin holes 25 are arranged on the surface of each support member 4 facing a corresponding recording element substrate 1 only at one of the opposite lateral sides of the support member 4 as viewed in the lateral direction of the corresponding recording element substrate 1 to make the support member 4 have an asymmetrical structure, which prevents the gap D from being large.

Figure 13B:
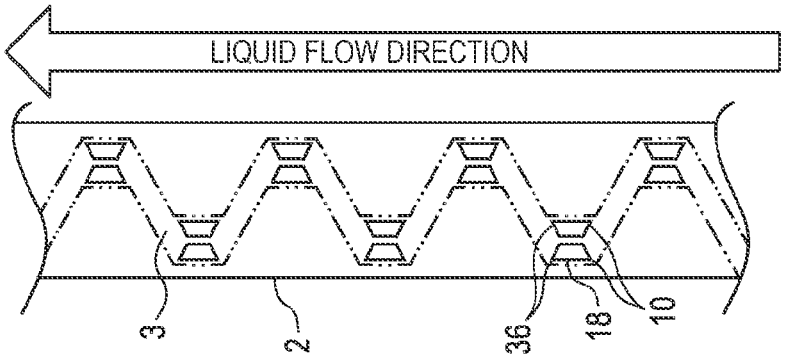
FIGS. 13A and 13B are schematic perspective views of another embodiment of liquid ejection head according to the present invention, illustrating the configuration thereof.
Figure 13A:
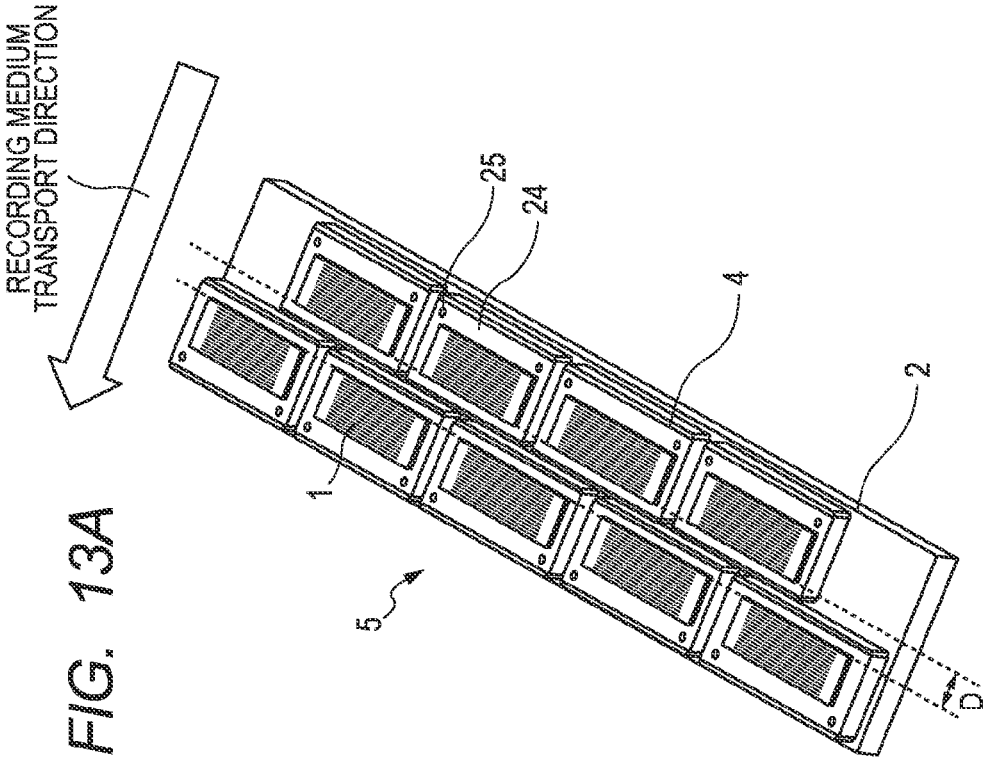

FIG. 13B is a schematic perspective view of the base substrate 2 of this embodiment as viewed from the side of the surface thereof on which support members 4 are arranged. Note that the common flow channel 3 in the base substrate 2 is represented by broken lines.

Although not illustrated in FIG. 13A, each distribution port 18 of the base substrate 2 has a profile same as that of the introduction port 9 of the corresponding support member 4 that communicates with the distribution port 18.

In this embodiment, each support member 4 is provided with two liquid chambers 6 and each of the liquid chambers 6 is provided with a distribution port 18. Note that each distribution port 18 (branch port 31) is formed at a position shifted from the center line running along the longitudinal direction of the corresponding support member 4 (ejection member 41). This description also applies to each introduction port 9. The distribution port upstream side notch portions 10 and the distribution port downstream side notch portions 36 are formed such that the profile of the distribution port 18 arranged to correspond to a support member 4 and that of the distribution port 18 arranged to correspond to a support member 4 located next to the former distribution port 18 in a direction orthogonal relative to the longitudinal direction of the liquid ejection head are rotationally symmetrical. Note that a distribution port upstream side notch portion 10 needs to be arranged in the corresponding distribution port 18. Therefore, although not illustrated, the profile of the introduction port 9 of a support member 4 and that of the introduction port 9 of the support member 4 located next to the former support member 4 in a direction orthogonal relative to the longitudinal direction of the liquid ejection head 5 are also rotationally symmetrical.

As distribution ports 18 and introduction ports 9 are formed in the above-described manner, support members 4 having a same profile can be used for upstream side rows of support members and also for downstream side rows of support members as viewed in the direction of transporting recording mediums even when support members 4 having asymmetrical profiles as illustrated in FIG. 13A are employed. In other words, common parts can be used for those members so that the manufacturing cost of liquid ejection heads 5 can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of the Japanese Patent Application No. 2013-196836, filed Sep. 24, 2013, which is hereby incorporated by reference herein in its entirety.

What is claimed is:

1. A liquid ejection head comprising:

a plurality of ejection members that have an ejection port for ejecting liquid and a plurality of liquid chambers for supplying liquid to the ejection ports;

a base substrate carrying the plurality of ejection members arranged thereon, the base substrate being provided with a common flow channel for supplying liquid to the plurality of liquid chambers; and a plurality of branch ports allowing the common flow channel to communicate with the plurality of liquid chambers, wherein an opening portion, fronting the common flow channel, of each of the branch ports is provided with a notch portion at an upstream side thereof as viewed in the flow direction of liquid flowing through the common flow channel.

2. The liquid ejection head according to claim 1, wherein the notch portion of each of the branch ports is arranged at one of opposite ends of the branch port as viewed in a direction orthogonal to the flow direction of liquid flowing through the common flow channel.

3. The liquid ejection head according to claim 1, wherein each of the branch ports has a profile that is asymmetrical relative to a center line of the branch port running along the flow direction of liquid flowing through the common flow channel.

4. The liquid ejection head according to claim 1, wherein another notch portion that is different from the upstream side notch portion is formed at a downstream side of each of the branch ports as viewed in the flow direction of liquid flowing through the common flow channel.

5. The liquid ejection head according to claim 4, wherein the ejection members are arranged in a zigzag manner on the base substrate along a longitudinal direction of the base substrate, while a single liquid chamber is arranged in each of the ejection members, and the profile of the branch port arranged in each of the ejection members and that of the branch port arranged in an ejection member located next to the former ejection member in a direction orthogonal relative to the longitudinal direction are rotationally symmetrical.

6. The liquid ejection head according to claim 4, wherein the ejection members are arranged in a zigzag manner on the base substrate along a longitudinal direction of the base substrate, while a plurality of liquid chambers are arranged in each of the ejection members, and the profile of the plurality of branch ports arranged in each of the ejection members and that of the plurality of branch ports arranged in the ejection member located next to the former ejection member in a direction orthogonal relative to the longitudinal direction are rotationally symmetrical.

7. The liquid ejection head according to claim 5, wherein the branch port of each of the ejection members is formed at a position shifted from the center line of the ejection member running along the longitudinal direction.

8. The liquid ejection head according to claim 1, wherein each of the branch ports includes an introduction port arranged in the corresponding ejection member and communicating with the liquid chamber, and a distribution port arranged in the base substrate and communicating with the common flow channel, the introduction port and the distribution port communicating with each other, and the base substrate being provided with a flow-in port for allowing liquid to flow into the common flow channel and a flow-out port for allowing liquid to flow out of the common flow channel.

9. The liquid ejection head according to claim 1, wherein each of the ejection members has a recording element substrate and a support member, and the ejection port of each of the ejection members is formed in the recording element substrate thereof while the liquid chamber is formed in the support member, and the recording element substrate of each of the ejection members is provided with a liquid supply port for supplying liquid from the liquid chamber to the ejection port.

10. A liquid ejection head comprising:

a plurality of ejection members that have an ejection port for ejecting liquid and a plurality of liquid chambers for storing liquid to be supplied to the ejection ports; and a support member supporting the plurality of ejection members, the support member having a common flow channel for supplying liquid to the plurality of ejection members, wherein the common flow channel communicates with the plurality of liquid chambers by way of respective openings, while an opening portion, fronting the common flow channel, of each of the openings is provided with a notch portion at an upstream side thereof as viewed in the flow direction of liquid flowing through the common flow channel and the upstream side of each of the openings has a profile that is asymmetrical relative to a line passing through the center of gravity of the opening and extending along the flow direction.

11. The liquid ejection head according to claim 10, wherein the notch portion of each of the openings is arranged at one of opposite ends of the opening as viewed in a direction orthogonal to the flow direction of liquid flowing through the common flow channel.

12. The liquid ejection head according to claim 10, wherein the plurality of ejection members are arranged along the common flow channel.

13. The liquid ejection head according to claim 10, wherein a second notch portion is formed in each of the openings at a downstream side thereof as viewed in the flow direction of liquid flowing through the common flow channel.

* * * * *